US009228514B2

(12) United States Patent
Hayashi et al.

(10) Patent No.: US 9,228,514 B2
(45) Date of Patent: Jan. 5, 2016

(54) CONTROL DEVICE FOR INTERNAL COMBUSTION ENGINE AND VEHICLE INCORPORATING CONTROL DEVICE

(75) Inventors: Kenji Hayashi, Okazaki (JP); Takumi Anzawa, Okazaki (JP); Eiji Fukushiro, Tokai (JP); Katsuhiko Yamaguchi, Nisshin (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 225 days.

(21) Appl. No.: 14/007,536

(22) PCT Filed: Mar. 31, 2011

(86) PCT No.: PCT/JP2011/058195

§ 371 (c)(1),
(2), (4) Date: Sep. 25, 2013

(87) PCT Pub. No.: WO2012/131970

PCT Pub. Date: Oct. 4, 2012

(65) Prior Publication Data

US 2014/0014065 A1 Jan. 16, 2014

(51) Int. Cl.

| | |
|---|---|
| ***F02D 41/00*** | (2006.01) |
| ***F02D 29/02*** | (2006.01) |
| ***F02D 41/02*** | (2006.01) |
| ***F02D 41/08*** | (2006.01) |
| ***F02D 41/16*** | (2006.01) |
| *F02D 41/14* | (2006.01) |

(52) U.S. Cl.

CPC ..... *F02D 41/0097* (2013.01); *F02D 29/02* (2013.01); *F02D 41/021* (2013.01); *F02D 41/08* (2013.01); *F02D 41/1497* (2013.01); *F02D 41/16* (2013.01); *F02D 41/086* (2013.01); *F02D 41/1498* (2013.01); *F02D 2200/0414* (2013.01); *F02D 2250/28* (2013.01)

(58) Field of Classification Search

CPC ..... F02D 41/00; F02D 41/021; F02D 41/08; F02D 41/0097; F02D 41/16; F02D 41/086; F02D 29/02; F02D 2200/0414; F02D 2250/28

See application file for complete search history.

(56) References Cited

U.S. PATENT DOCUMENTS 5,784,878 A * 7/1998 Kato ..... F01N 3/2013 123/339.18
8,868,320 B2 * 10/2014 Anzawa ..... F02D 17/04 123/179.4

(Continued)

FOREIGN PATENT DOCUMENTS

CN 101678827 A 3/2010
EP 0900683 A2 3/1999

(Continued)

*Primary Examiner* — Hieu T Vo
(74) *Attorney, Agent, or Firm* — Sughrue Mion, PLLC

(57) ABSTRACT

An ECU for controlling an engine counts the continued period of stopping the engine in a low-temperature environment. The ECU sets the idle rotational speed at a first idle rotational speed when the stopped period is below a predetermined threshold value, and at a second idle rotational speed higher than the first idle rotational speed when the stopped period exceeds the reference value. Accordingly, resonance at the driving force transmission system during idle operation can be prevented even in the case where a mount employed for attaching the engine to the vehicle is hardened as a result of undergoing a low-temperature environment for a long period of time, and the resonant rotational speed of the driving force transmission system including the engine varies.

15 Claims, 9 Drawing Sheets

(56) References Cited

U.S. PATENT DOCUMENTS

| | | | |
|---|---|---|---|
| 2005/0029036 | A1 | 2/2005 | Yamamoto et al. |
| 2005/0225175 | A1 | 10/2005 | Maehara et al. |
| 2010/0048353 | A1 | 2/2010 | Iwase et al. |
| 2010/0152938 | A1 | 6/2010 | Aoki et al. |

FOREIGN PATENT DOCUMENTS

| | | | | | |
|---|---|---|---|---|---|
| JP | S63-111338 | A | | 5/1988 | |
| JP | H07-266896 | A | | 10/1995 | |
| JP | 2004-308511 | A | | 11/2004 | |
| JP | 2004-332564 | A | | 11/2004 | |
| JP | 2005054931 | A | | 3/2005 | |
| JP | 2005-325832 | A | | 11/2005 | |
| JP | 2006-152877 | A | | 6/2006 | |
| JP | 2007-118728 | A | | 5/2007 | |
| JP | 2009180094 | A | | 8/2009 | |
| JP | 2009228538 | A | | 10/2009 | |
| JP | 2012214059 | A | * | 11/2012 | ..... B60W 10/06 |

* cited by examiner

CONTROL DEVICE FOR INTERNAL COMBUSTION ENGINE AND VEHICLE INCORPORATING CONTROL DEVICE

CROSS REFERENCE TO RELATED APPLICATIONS

This application is a National Stage of International Application No. PCT/JP2011/058195 filed Mar. 31, 2011, the contents of which are incorporated herein by reference in their entirety.

TECHNICAL FIELD

The present invention relates to a control device for an internal combustion engine, and a vehicle incorporating the control device. More particularly, the present invention relates to control of setting the idle rotational speed of the internal combustion engine.

BACKGROUND ART

At the engine constituting an internal combustion engine, the rotational speed of the engine in the so-called idle drive (hereinafter, also referred to as "idle rotational speed") in which a self-sustained operation is conducted in a state where the driving force is not transmitted to the load after the engine has been started is desirably set as low as possible in a range where self-sustained operation is allowed for the purpose of reducing fuel consumption.

During the operation of the engine, vibration will occurs thereby. The idle rotational speed is set higher than the rotational speed at which resonance of the driving force transmission system including the engine occurs (hereinafter, also referred to as "resonant rotational speed") for the purpose of reducing vibration during idle operation.

Japanese Patent Laying-Open No. 2006-152877 (PTL 1) discloses a hybrid vehicle that has the mounted engine started by cranking through a motor, in which the motor is configured to set the engine rotational speed lower than the resonant rotational speed when there is a possibility of matching the resonant rotational speed of the driving force transmission system at the time of cranking due to suppressing the increase of the engine rotational speed.

According to the configuration disclosed in Japanese Patent Laying-Open No. 2006-152877 (PTL 1), resonance at the driving force transmission system can be suppressed even in the case where there is a possibility of the engine rotational speed matching the resonant rotational speed due to reduction of the motor output caused by increase of friction torque or lower battery output at the time of cranking during engine starting.

CITATION LIST

Patent Literature

PTL 1: Japanese Patent Laying-Open No. 2006-152877
PTL 2: Japanese Patent Laying-Open No. 2007-118728

SUMMARY OF INVENTION

Technical Problem

The idle rotational speed of the engine is generally set to a value differing from the rotational speed corresponding to the resonant frequency of the driving force transmission system to which vibration from the engine is conveyed (resonant rotational speed) for the purpose of reducing vibration during idle operation.

However, when the vehicle is continuously left in a state where the engine is stopped for a long period of time under a low-temperature environment (for example, lower than −15° C.) at cold districts and the like, the resonant rotational speed of the driving force transmission system may vary. Therefore, in the case where the vehicle is continuously left in a state where the engine is stopped under a low-temperature environment, the resonant rotational speed of the driving force transmission system will come close to the idle rotational speed, leading to the possibility of greater vibration during idle operation.

In view of the foregoing, an object of the present invention is to suppress increase of vibration during idle operation corresponding to the case where the engine was stopped continuously in a low-temperature environment.

Solution to Problem

A control device for an internal combustion engine of the present invention counts the stopped period of the internal combustion engine, and when the stopped period is long, sets the idle rotational speed of the internal combustion engine at a value differing from that set when the stopped period is short.

Preferably, the control device sets the idle rotational speed at a greater value when the stopped period is long as compared to the value set when the stopped period is short.

Preferably, the control device sets the idle rotational speed when the stopped period exceeds a predetermined reference value differing from that set when the stopped period is below the reference value.

Preferably, the control device sets the idle rotational speed at a first idle rotational speed when the stopped period is below a predetermined reference value, and sets the idle rotational speed at a second idle rotational speed differing from the first idle rotational speed when the stopped period exceeds the reference value. The second idle rotational speed is set at a value larger than the value of the first idle rotational speed.

Preferably, the control device sets the idle rotational speed at the second idle rotational speed when a value associated with a temperature during starting the internal combustion engine is below a threshold value, and the stopped period exceeds the reference value.

Preferably, the internal combustion engine is attached to the vehicle by means of a fixture member. The resonant frequency of the driving force transmission system including the internal combustion engine has the property of increasing as the fixture member is reduced in temperature.

Preferably, when the stopped period exceeds the reference value, the control device modifies the second idle rotational speed according to the stopped period.

Preferably, the control device increases the second idle rotational speed when the stopped period is long than when the stopped period is short in an event of the stopped period exceeding the reference value.

Preferably, the internal combustion engine has a detection unit provided for detecting vibration at the internal combustion engine. The control device modifies the second idle rotational speed according to a value associated with the degree of vibration at the internal combustion engine based on a signal from the detection unit.

Preferably, the control device sets the second idle rotational speed at a greater value when a value associated with the degree of vibration is large, as compared to the value set when the value associated with the degree of vibration is small.

Preferably, the control device returns the idle rotational speed to the first idle rotational speed when the state in which the idle rotational speed is set at the second idle rotational speed exceeds a predetermined period.

Preferably, the internal combustion engine is used together with a traction motor. The control device controls the internal combustion engine and the traction motor such that the required driving force is generated from the internal combustion engine and traction motor, and when the idle rotational speed is set at the second idle rotational speed, sets the output of the internal combustion engine at a value differing from that set when the idle rotational speed is set at the first idle rotational speed.

Preferably, the control device controls the internal combustion engine according to a map having defined in advance an operation line defining the relationship between the rotational speed of the internal combustion engine and driving force. When the idle rotational speed is set at the second idle rotational speed, the control device alters the driving force of the internal combustion engine according to the operation line.

Preferably, the control device counts the time when the internal combustion engine is stopped under the state where a value associated with temperature is below the threshold value, as the stopped period.

Preferably, the control device resets the count of stopped period when the internal combustion engine is started.

A vehicle according to the present invention includes an internal combustion engine, and a control device for controlling the internal combustion engine. The control device counts the stopped period of the internal combustion engine, and when the stopped period is long, sets the idle rotational speed of the internal combustion engine at a value differing from that set when the stopped period is short.

Preferably, the vehicle further includes an electric motor. The vehicle runs using at least one of the driving force generated by the internal combustion engine and the driving force generated by the electric motor. The control device controls the distribution between the driving force generated by the internal combustion engine and the driving force generated by the electric motor such that the required driving force is output. The control device alters the driving force generated by the internal combustion engine in response to a modification in the idle rotational speed.

Preferably, the internal combustion engine is attached to the vehicle by means of a fixture member. The resonant frequency of a driving transmission system including the internal combustion engine has the property of increasing as the fixture member is reduced in temperature.

Advantageous Effects of Invention

According to the present invention, increase in vibration during idle operation can be suppressed in the case where the engine was stopped continuously in a low-temperature environment.

DESCRIPTION OF EMBODIMENTS

Figure 1:
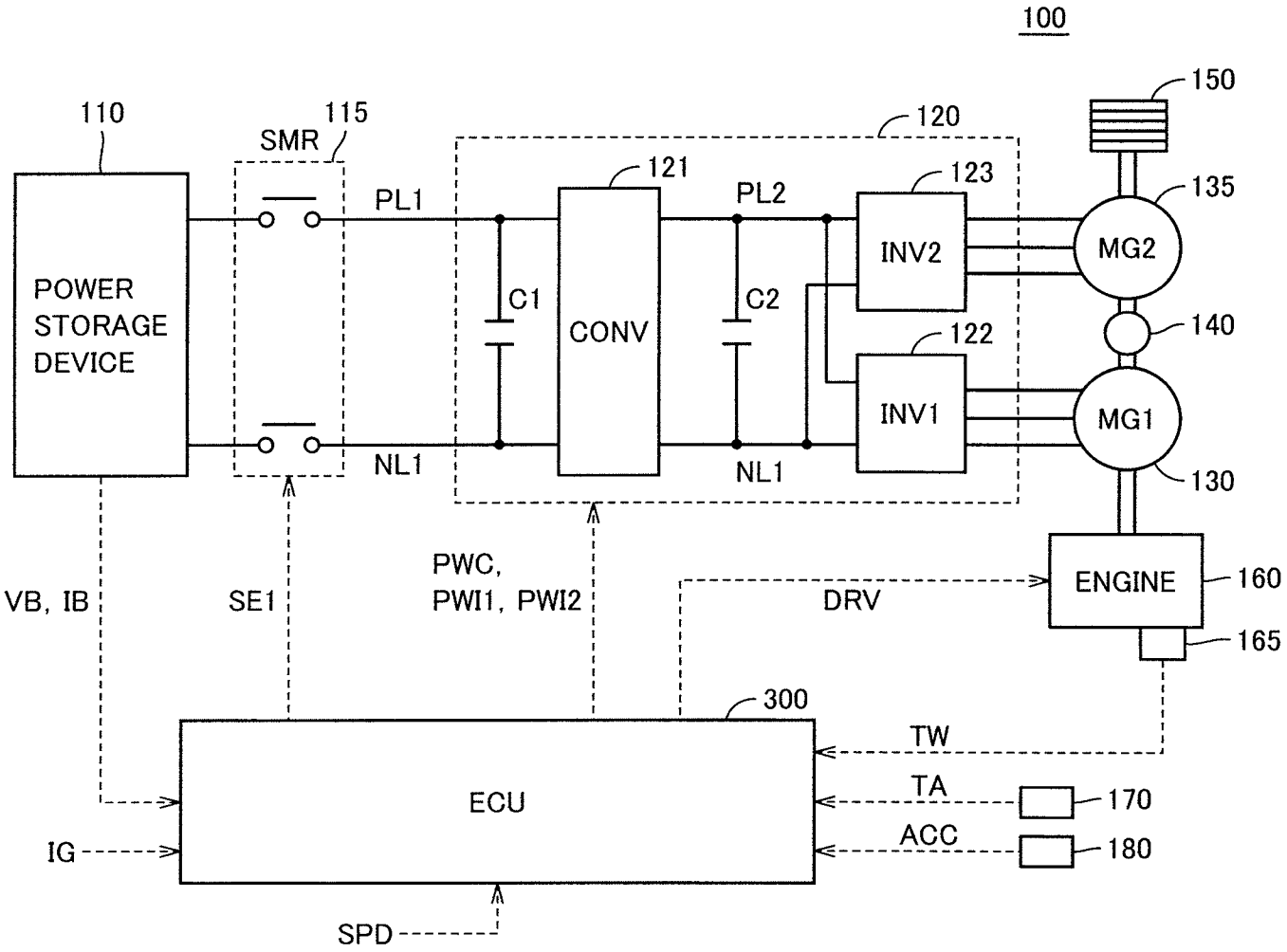
FIG. 1 is an overall block diagram of a vehicle according to an embodiment.

Embodiments of the present invention will be described in detail hereinafter with reference to the drawings. In the drawings, the same or corresponding elements have the same reference characters allotted, and description thereof will not be repeated.

[Overall Configuration of Vehicle]

FIG. 1 is an overall block diagram of a vehicle 100 according to the present embodiment. Referring to FIG. 1, vehicle 100 includes a power storage device 110, a system main relay (SMR) 115, a power control unit (PCU) 120 that is a drive device, motor generators 130 and 135, a power transmission gear 140, a driving wheel 150, an engine 160 that is an internal combustion engine, and an electronic control unit (ECU) 300 that is a control device. PCU 120 includes a converter 121, inverters 122 and 123, and capacitors C1 and C2.

Power storage device 110 is an electric power storage element configured to allow charging and discharging. Power storage device 110 is constituted of a secondary battery such as a lithium ion battery, a nickel hydride metal battery, or lead storage battery, or a power storage element such as an electrical double layer capacitor.

Power storage device 110 is connected to PCU 120 via a power line PL1 and a ground line NL1. Power storage device 110 supplies to PCU 120 the electric power directed to generating the driving force of vehicle 100. Power storage device 110 also stores the electric power generated at motor generators 130 and 135. The output of power storage device 110 is approximately 200V, for example.

A relay included in SMR 115 is inserted at a power line PL1 and ground line NL1 connecting power storage device 110 and PCU 120. SMR 115 switches between supplying and cutting off the electric power between power storage device 110 and PCU 120 based on a control signal SE1 from ECU 300.

Converter 121 carries out voltage conversion between power line PL1, ground line NL1 and power line PL2, ground line NL1 based on a control signal PWC from ECU 300.

Inverters 122 and 123 are connected parallel to power line PL2 and ground line NL1. Inverters 122 and 123 convert DC power supplied from converter 121 into AC power based on control signals PWI1 and PWI2 from ECU 300 to drive motor generators 130 and 135, respectively.

Capacitor C1 is provided between power line PL1 and ground line NL1 to reduce the voltage variation therebetween. Capacitor C2 is provided between power line PL2 and ground line NL1 to reduce voltage variation therebetween.

Motor generators 130 and 135 are AC rotating electric machines, for example a permanent magnet type synchronous electric motor including a rotor having a permanent magnet embedded.

The output torque from motor generators 130 and 135 is transmitted to driving wheel 150 via power transmission gear 140 constituted of a reducer and power split mechanism to cause vehicle 100 to run. Motor generators 130 and 135 can generate power by the rotary force of driving wheel 150 in a regenerative braking operation mode of vehicle 100. The generated electric power is converted into the charging power for power storage device 110 by PCU 120.

Motor generators 130 and 135 are also coupled to engine 160 via power transmission gear 140. Motor generators 130 and 135 and engine 160 operate cooperatively under ECU 300 to generate the required vehicle driving force. Motor generators 130 and 135 can generate electric power by the rotation of engine 160, and can charge power storage device 110 using the generated electric power. In the present embodiment, motor generator 135 is exclusively used as an electric motor for driving wheel 150, whereas motor generator 130 is exclusively used as a power generator driven by engine 160.

Engine 160 has the rotational speed, valve open/close timing, fuel flow rate and the like controlled by a control signal DRV from ECU 300 to generate the driving force for causing vehicle 100 to run.

Although a configuration of a hybrid vehicle that runs using at least one of the driving force from engine 160 and the driving force from motor generators 130 and 135 is shown in FIG. 1 by way of example, the present embodiment is applicable as long as the configuration includes at least an engine. Therefore, a vehicle having only an engine, absent of a motor generator, or a hybrid vehicle including only one or more than two motor generators may be employed.

Engine 160 is provided with a temperature sensor 165 to detect the temperature of the coolant of engine 160. Temperature sensor 165 outputs to ECU 300 a signal associated with the detected coolant temperature TW.

Vehicle 100 also includes a temperature sensor 170 to detect the outside temperature, and a vibration sensor 180 to detect vibration at the vehicle. Temperature sensor 170 outputs to ECU 300 a signal TA associated with the detected outside temperature. Vibration sensor 180 is, for example, an acceleration sensor, providing a signal associated with the detected vehicle body vibration acceleration ACC to ECU 300.

ECU 300 includes a CPU (Central Processing Unit), a storage device, and an input/output buffer, all not shown in FIG. 1, to effect input of a signal from each sensor and/or output of a control signal to each device, and controls vehicle 100 as well as each device. Control thereof is not limited to processing through software, and can be processed through dedicated hardware (electronic circuitry).

ECU 300 calculates the state of charge (SOC) of power storage device 110 based on the detected values of a voltage VB and a current IB from a voltage sensor and current sensor (not shown) provided at power storage device 110. ECU 300 receives a signal associated with vehicle speed SPD from a speed sensor not shown.

ECU 300 receives an ignition signal IG for starting the vehicle, input through an operation by the user. ECU 300 responds to the reception of ignition signal IG to close SMR 115 and transmit the electric power from power storage device 110 to PCU 120. Alternatively, or in addition, ECU 300 outputs a control signal DRV to start engine 160.

Although FIG. 1 shows a configuration in which one ECU 300 is provided as the control device, a configuration may be employed in which a separate control device is provided for each function or for each device that is the subject of control such as a control device for PCU 120 and/or a control device for power storage device 110, for example.

First Embodiment

In order to reduce vibration during idle operation, the idle rotational speed of the engine is generally set at a value differing from the rotational speed corresponding to the resonant frequency of the driving force transmission system to which the vibration from the engine is conveyed (resonant rotational speed).

However, in the case where the vehicle continues to take a state in which the engine is stopped for a long period of time under a low-temperature environment (for example, below −15° C.) in a cold district or the like, the resonant rotational speed of the driving force transmission system may change. Therefore, in the case where the vehicle continues to take a state in which the engine is stopped at a low-temperature environment, the vibration during idle operation may be increased due to the resonant rotational speed of the driving force transmission system coming close to the idle rotational speed.

When the engine is to be attached to the body in the aforementioned vehicle, the engine is generally attached with a fixture member (a mount) having resilience such as rubber, for example, to prevent the vibration caused by the engine being operated from being directly conveyed to the vehicle body.

The resonant frequency of the driving force transmission system including the engine varies depending upon the resilient modulus of the mount used for attaching. In the case where the vehicle is left in a state where the engine is stopped for a long period of time under an extremely low-temperature environment such as in a cold weather region, the mount may be hardened depending upon the property thereof, leading to change in the resonant rotational speed of the driving force transmission system. It is generally known that the resonant frequency becomes higher when the mount is hardened, i.e. the resilient modulus is reduced. Therefore, in the case where the vehicle is left unattended for a long period of time under a low-temperature environment, the resonant rotational speed of the driving force transmission system will approach the idle rotational speed, leading to the possibility of causing greater vibration during idle operation.

In the first embodiment, idle speed modification control directed to suppressing occurrence of resonance at the driving force transmission system during idle operation is carried out by modifying the idle rotational speed according to the stopped period corresponding to the state where the vehicle engine remains stopped under a low-temperature environment.

Figure 2:
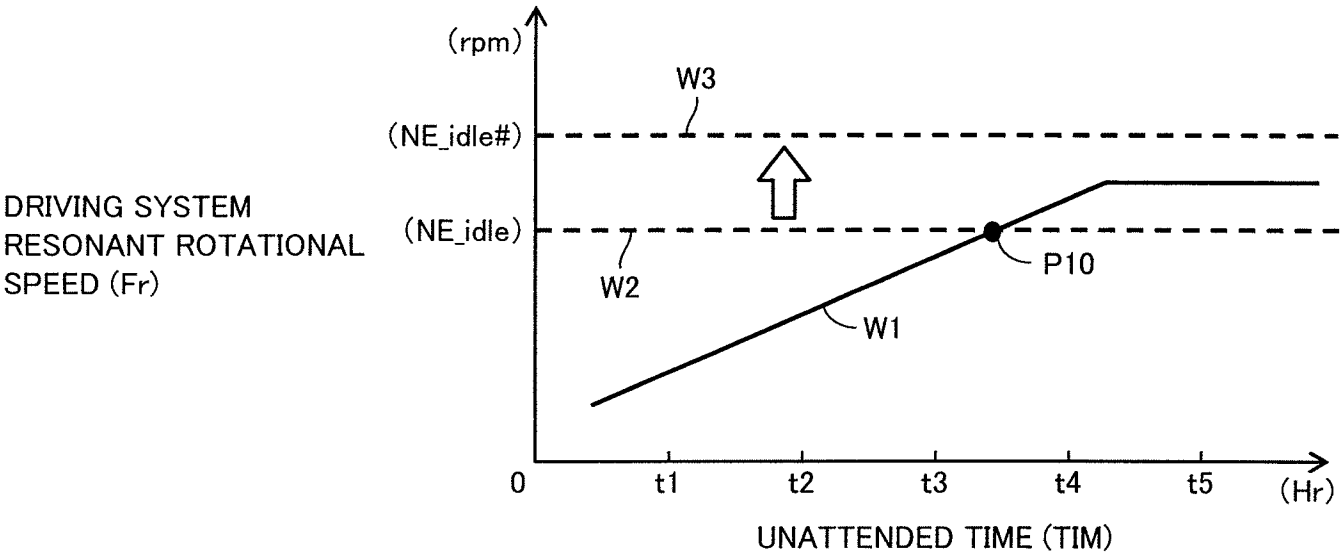
FIG. 2 is a diagram to describe the outline of idle speed modification control according to a first embodiment.

FIG. 2 is a diagram to describe the outline of idle speed modification control of the first embodiment. In FIG. 2, the horizontal axis represents the stopped period of the engine left under a low-temperature environment (hereinafter, also referred to as "unattended time") TIM, whereas the vertical axis represents the resonant rotational speed Fr at which resonance occurs at the driving force transmission system including the engine.

Referring to FIGS. 1 and 2, resonant rotational speed Fr of the driving force transmission system increases as indicated by the solid line W1 in FIG. 2 as unattended time TIM becomes longer, caused by the hardening of the mount, and is saturated in the vicinity of a certain resonant rotational speed.

When engine 160 is started to achieve idle operation under the state where resonant rotational speed Fr reaches or is in the vicinity of a point P10 matching the idle rotational speed NE_idle (for example, 1300 rpm) of engine 160 at normal temperature (broken straight line W2 in FIG. 2), there is a possibility of resonance at the driving force transmission system due to the vibration occurring at engine 160 particularly immediately after starting.

In the first embodiment where the mount has the property as shown in FIG. 2, the setting value of the idle rotational speed is modified to an idle rotational speed NE_idle# (for example, 1500 rpm) higher than the idle rotational speed NE_idle at normal temperature, as indicated by the broken straight line W3 in FIG. 2, in response to attaining an unattended time t3 (for example, 72 hours) at which resonant rotational speed Fr approaches the rotational speed corresponding to idle rotational speed NE_idle. Accordingly, the idle rotational speed can be made to fall away from the resonant rotational speed of the driving force transmission system, such that resonance at the driving force transmission system can be prevented.

Figure 3:
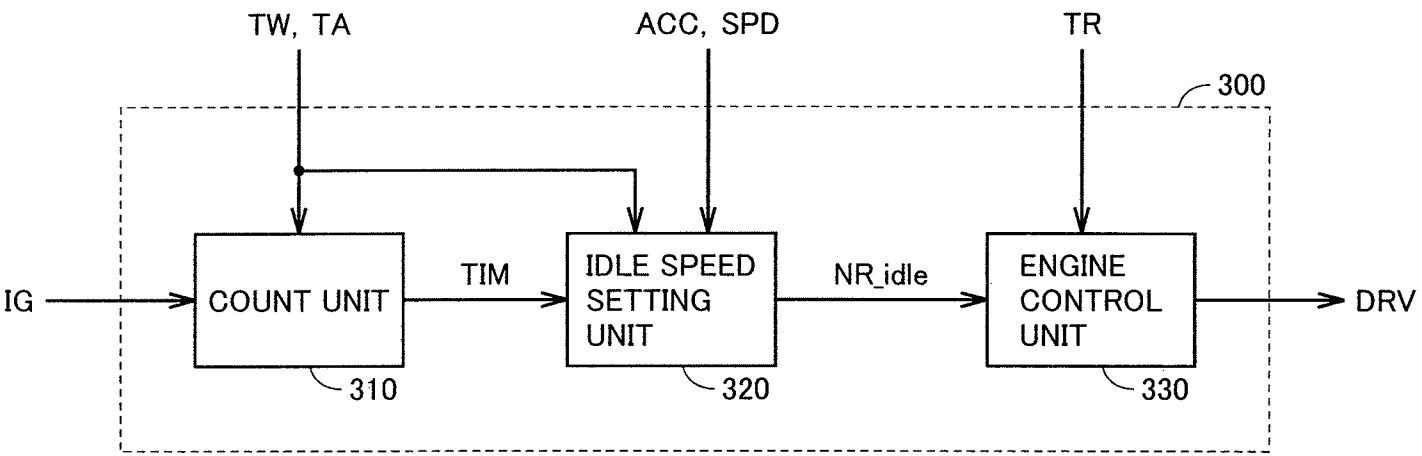
FIG. 3 is a functional block diagram to describe idle speed modification control executed at an ECU according to the first embodiment.

FIG. 3 is a functional block diagram to describe the idle speed modification control executed at ECU 300 according to the first embodiment. Each functional block in FIG. 3 is implemented by hardware or software processing at ECU 300.

Referring to FIGS. 1 and 3, ECU 300 includes a count unit 310, an idle speed setting unit 320, and an engine control unit 330.

Count unit 310 receives an ignition signal IG through an operation by the user, as well as coolant temperature TW and ambient temperature TA from temperature sensors 165 and 170. Based on such information, count unit 310 counts unattended time TIM of the state where the engine is left without being started under a low-temperature environment. Count unit 310 outputs the calculated unattended time TIM to idle speed setting unit 320.

Idle speed setting unit 320 receives unattended time TIM from count unit 310, coolant temperature TW and ambient temperature TA from temperature sensors 165 and 170, vibration acceleration ACC from vibration sensor 180, and vehicle speed SPD from a speed sensor not shown. Idle speed setting unit 320 sets and provides to engine control unit 330 a reference value NR_idle of the idle rotational speed in an idle operation mode based on such information described with reference to FIG. 2.

Engine control unit 330 receives idle rotational speed reference value NR_idle from idle speed setting unit 320. Engine control unit 330 generates a control signal DRV such that the rotational speed of engine 160 attains a rotational speed according to reference value NR_idle in an idle operation mode, and controls engine 160. Engine control unit 330 generates a control signal DRV such that torque TR defined by an accelerator pedal operation or the like by the user is output, and controls engine 160.

Figure 4:
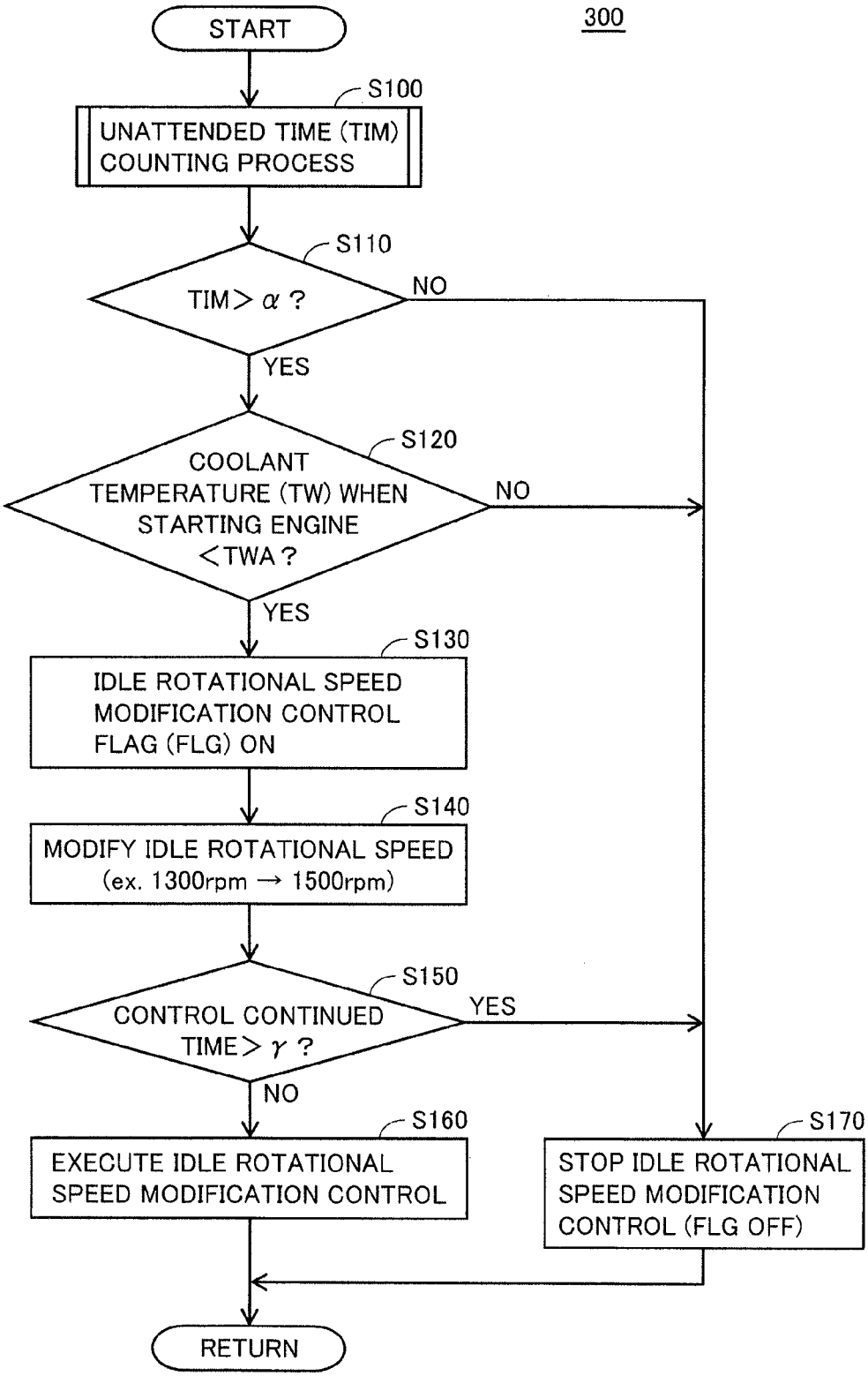
FIG. 4 is a flowchart to describe in detail an idle speed modification control process executed at the ECU in the first embodiment.

FIG. 4 is a flowchart to describe in detail the idle speed modification control process executed at ECU 300 according to the first embodiment. The flowcharts shown in FIG. 4 and FIGS. 5, 7, 9 and 10 that will be described afterwards are implemented by a program stored in advance at ECU 300, invoked from the main routine and executed at a predetermined cycle. Alternatively, a portion of or all of the steps may be implemented by processing through dedicated hardware (electronic circuitry).

Referring to FIGS. 1 and 4, ECU 300 counts unattended time TIM of the vehicle under a low-temperature environment at step (hereinafter, abbreviated as S) 100. The details of the count process at S100 will be described afterwards with reference to FIG. 5.

At S110, ECU 300 determines whether the unattended time TIM calculated at S100 is greater than a predetermined reference value α.

When unattended time TIM is less than or equal to a reference value α (NO at S110), ECU 300 determines that the resonant rotational speed of the driving force transmission system has not reached the vicinity of the idle rotational speed. ECU 300 proceeds to S170 where the processing ends without modifying the idle rotational speed.

When unattended time TIM is greater than reference value α (YES at S110), control proceeds to S120 where a determination is made whether or not coolant temperature TW at the time of starting engine 160 is smaller than a predetermined threshold value TWA. This is directed to determining whether or not the vehicle was in a low-temperature environment at the point in time of starting engine 160. Although coolant temperature TW reflecting the actual temperature of engine 160 is employed as the index of being in a low-temperature environment at S120, another signal such as ambient temperature TA from temperature sensor 170, for example, may be used instead for such determination.

When coolant temperature TW is greater than or equal to threshold value TWA (NO at S120), ECU 300 determines that the ambient temperature is high such as during the day time and the possibility of the hardened state of the mount being alleviated is high so that the resonant rotational speed of driving force transmission system has not reached the vicinity of the idle rotational speed. Thus, ECU 300 proceeds to S170 to end the process without modifying the idle rotational speed.

In contrast, when coolant temperature TW is smaller than threshold value TWA (YES at S120), ECU 300 determines that the vehicle is in a low-temperature environment, and the possibility of the resonant rotational speed of the driving force transmission system reaching the vicinity of the idle rotational speed is high. ECU 300 sets a control flag FLG of idle speed modification control ON at S130, and modifies reference value NR_idle of the idle rotational speed to rotational speed NE_idle# (for example, 1500 rpm) that is higher than rotational speed NE_idle (for example, 1300 rpm) set at normal temperature. The modified rotational speed NE_idle# may be set lower than the rotational speed NE_idle set at normal temperature as long as resonant rotational speed of the driving force transmission system can be avoided, and engine 160 can be operated stably.

Then, ECU 300 determines at S150 whether or not a predetermined time elapsed under the state where control flag FLG is set ON, i.e. whether or not the control continuation time is greater than a predetermined reference value γ.

When the control continuation time is less than or equal to reference value γ (NO at S150), ECU 300 determines that softening of the mount by the vibration energy generated by the idle operation of engine 160 is not yet sufficient. Accordingly, control proceeds to S160 where ECU 300 continues idle speed modification control and maintains an idle rotational speed NE_idle# that is higher than that set at normal temperature.

When the control continuation time is greater than reference value γ (YES at S150), ECU 300 determines that the hardening of the mount that supports engine 160 is alleviated by the thermal energy and vibration energy generated by the idle operation of engine 160. In other words, ECU 300 determines that the resonant rotational speed of the driving force transmission system is reduced, falling away from idle rotational speed NE_idle set at normal temperature. Then, control proceeds to S170 where ECU 300 stops the idle speed modification control, and returns the idle rotational speed to the normal temperature idle rotational speed NE_idle, and sets control flag FLG OFF.

Thus, the control according to the process set forth above allows suppression of increase in vibration caused by resonance during idle operation due to the mount supporting the engine being hardened as a result of the vehicle being left under a low-temperature environment for a long period of time, leading to higher resonant rotational speed of the driving force transmission system. Furthermore, since the idle rotational speed is modified upon predicting occurrence of vibration, the event of vibration being caused by resonance can be reduced in frequency.

Although the configuration of FIG. 4 is based on executing idle speed modification control when coolant temperature TW in an engine starting mode is lower than threshold value TWA (S120), the processing of step S120 is arbitrary. The idle speed modification control may be executed when unattended time TIM is greater than reference value α, irrespective of coolant temperature TW during engine starting.

Figure 5:
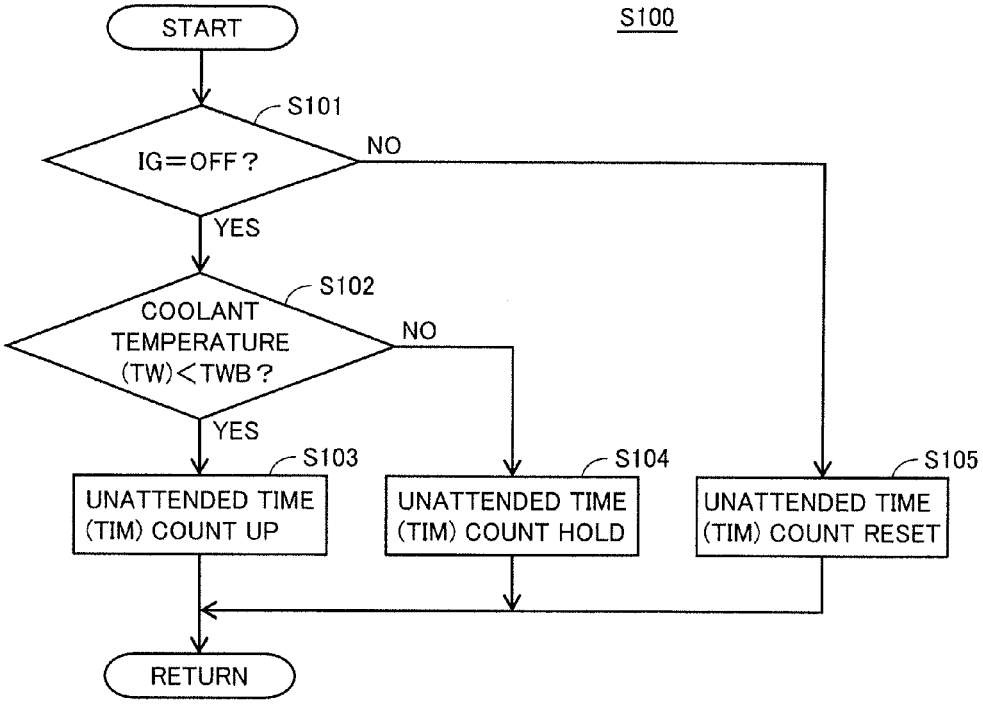
FIG. 5 is a flowchart representing in detail the count process of a vehicle unattended time at step S100 of FIG. 4.

FIG. 5 is a flowchart showing in detail the unattended time count process of step S100 in FIG. 4. Referring to FIGS. 1 and 5, ECU 300 determines whether or not ignition signal IG through an operation by the user is OFF at S101.

When ignition signal IG is OFF (YES at S101), control proceeds to S102 where ECU determines whether or not coolant temperature TW is smaller than threshold value TWB, i.e. whether or not the current state corresponds to a low-temperature environment. The signal used in the determination at S102 is not limited, and another signal allowing determination of a low-temperature environment may be employed, as described at S120 set forth above. Moreover, threshold value TWB may take a value identical to that of threshold value TWA of S120, or may be another value.

When coolant temperature TW is lower than threshold value TWB (YES at S102), control proceeds to S103 where ECU 300 counts up unattended time TIM according to the determination of being in a low-temperature environment.

When coolant temperature TW is higher-than threshold value TWB (NO at S102), ECU 300 determines that the current state does not correspond to a low-temperature environment. Control proceeds to S104 where the current count value is maintained without counting up unattended time TIM.

An ON state of ignition signal IG (YES at S101) implies that the engine is started. Therefore, control proceeds to S105 where ECU 300 stores the value of unattended time TIM and resets the value of the counter. ECU 300 executes the processing set forth below using the stored unattended time TIM.

In the flowchart of FIG. 5, although unattended time TIM is counted up only when coolant temperature TW is lower than threshold value TWB, the step of S102 is arbitrary. Unattended time TIM may be counted up when ignition switch IG is OFF, irrespective of coolant temperature TW.

In a hybrid vehicle, there may be the case where engine 160 is not necessarily started even when ignition signal IG is turned ON. In this case, the hardening of the mount may not be alleviated even if ignition switch IG is ON.

Therefore, for a hybrid vehicle, the process of S101 may be determined based on a control signal DRV towards engine 160, for example. It is to be noted that when the vehicle is running for over a predetermined time using the driving force from the motor generator even if engine 160 is not actually started, there is a possibility of the hardening of the mount being alleviated by the heat and vibration generated in accordance with the running of the vehicle. Therefore, in the case where a determination is made based on control signal DRV to engine 160, a determination as to whether or not the unattended time is to be reset can be made taking into account the actual running state of the vehicle.

Second Embodiment

The first embodiment was described based on a configuration in which the engine idle rotational speed is modified to a specified settled idle rotational speed (NE_idle#) at the elapse of a predetermined time of the engine stop continuing time (unattended time).

It is to be noted that idle rotational speed NE_idle# subsequent to the modification is set at a value greater than the maximum value of resonant rotational speed Fr of the driving force transmission system, as shown in FIG. 2. This means that the idle rotational speed is set higher than required during t3 to t4 of the unattended time in FIG. 2. There is a possibility of excessively degrading the mileage due to excessive fuel consumption.

The second embodiment is directed to a configuration in which the idle rotational speed subsequent to modification can be set variably according to the unattended time. Resonance during idle operation at a low-temperature environment can be suppressed while minimizing degradation in mileage.

Figure 6:
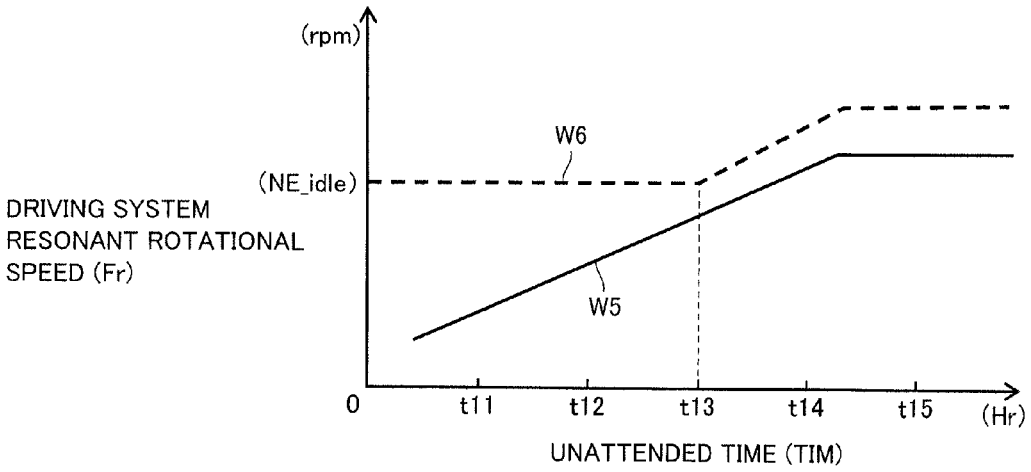
FIG. 6 is a diagram to describe the outline of idle speed modification control according to a second embodiment.

FIG. 6 is a diagram to describe the outline of idle speed modification control according to the second embodiment. In FIG. 6, the horizontal axis represents the stopped period of the engine left under a low-temperature environment (unattended time) TIM, whereas the vertical axis represents the resonant rotational speed Fr at which resonance occurs at the driving force transmission system including the engine, likewise with FIG. 2 of the first embodiment.

Referring to FIGS. 1 and 6, resonant rotational speed Fr of the driving force transmission system becomes higher as a function of longer unattended time, and is saturated in the vicinity of a certain resonant rotational speed (line W5 in FIG. 6).

The idle rotational speed is set at idle rotational speed NE_idle corresponding to normal temperature until t3 of unattended TIM. At the elapse of t3 of unattended time TIM, the idle rotational speed is set to increase while maintaining a predetermined distance in accordance with increase of resonant rotational speed Fr. From the standpoint of improving fuel consumption, this predetermined distance is preferably set as small as possible within the range of not increasing the vibration at the driving force transmission system by the idle rotational speed.

Figure 7:
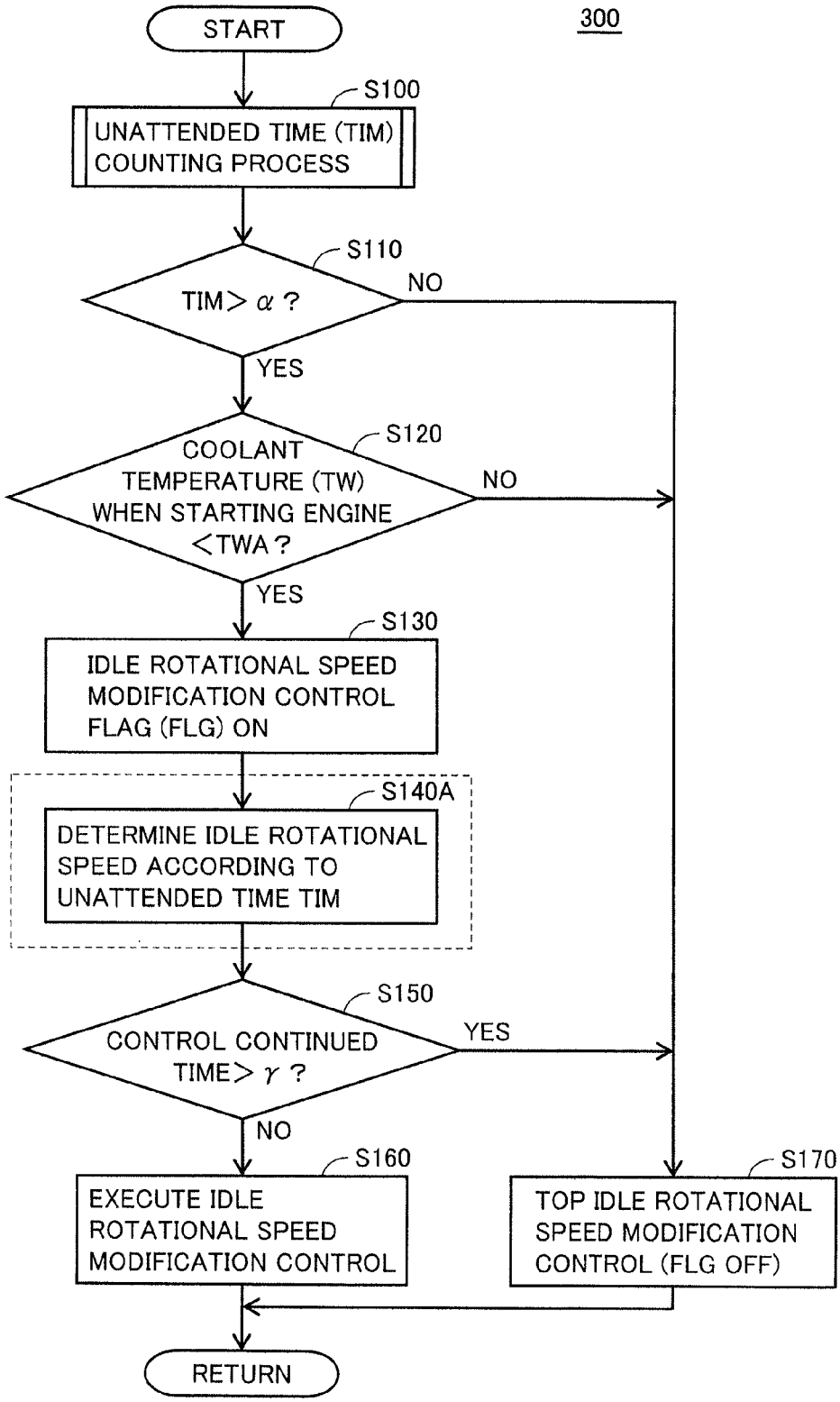
FIG. 7 is a flowchart to describe in detail an idle speed modification control process executed at the ECU in the second embodiment.

FIG. 7 is a flowchart to describe in detail the idle speed modification control process executed at ECU 300 according to the second embodiment. In FIG. 7, step S140 in the flowchart of FIG. 4 described in the first embodiment is replaced with step S140A. In FIG. 7, steps coinciding with those in FIG. 4 will not be repeatedly described.

Referring to FIG. 7, when ECU 300 determines that unattended time TIM is greater than a predetermined reference value α (YES at S110), and that coolant temperature TW in an engine starting mode is smaller than threshold value TWA (YES at S120), control proceeds to S130 where idle rotational speed modification control flag FLG is set ON.

Then, control proceeds to S140A where ECU 300 sets the idle rotational speed according to unattended time TIM using the map shown in FIG. 6.

At S150, ECU 300 executes idle operation using the idle rotational speed set at S140A until the idle rotational speed modification control continuation time reaches predetermined value γ.

The control according to the process set forth above allows suppression of resonance at the driving force transmission system during idle operation that may occur in accordance with the hardening of the mount under a low-temperature environment while minimizing degradation in mileage.

Third Embodiment

The control according to the first embodiment and the second embodiment is applicable to any vehicle incorporating an engine.

A hybrid vehicle as shown in FIG. 1 may be controlled such that the engine command power and motor generator target torque are determined based on the driver required torque.

The third embodiment is directed to a configuration in which the engine command power is modified according to a change in the idle rotational speed so as to attain optimum engine efficiency in the case where the idle speed modification control described in the first and second embodiments is applied to the hybrid vehicle shown in FIG. 1.

Figure 8:
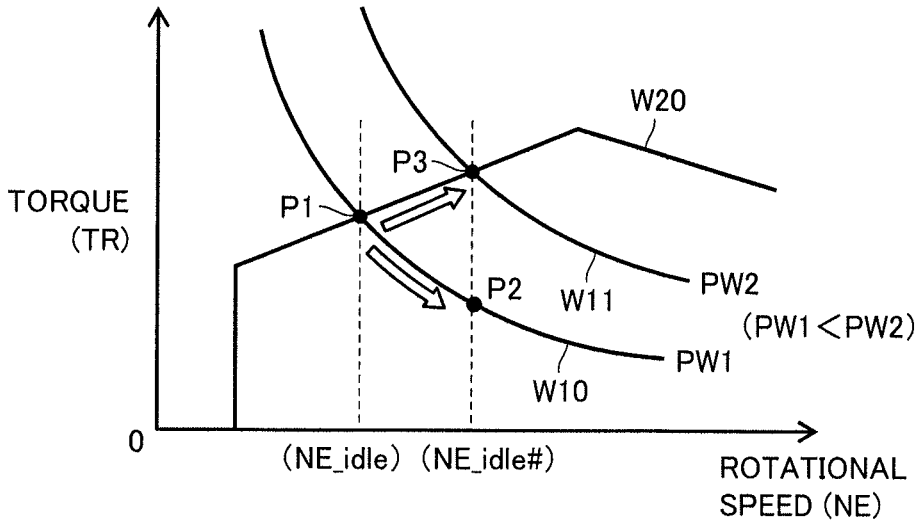
FIG. 8 is a diagram to describe the outline of the setting scheme of engine rotational speed and torque when idle speed modification control is applied to a hybrid vehicle according to a third embodiment.

FIG. 8 is a diagram to describe the outline of engine rotational speed and torque setting method when the idle speed modification control is applied to a hybrid vehicle in the third embodiment. In FIG. 8, the horizontal axis represents the engine rotational speed NE whereas the vertical axis represents the torque TR towards the engine.

Referring to FIGS. 1 and 8, line W20 in FIG. 8 is an operation line indicating the relationship between rotational speed NE and torque TR for optimum efficiency based on the property of engine 160.

Assuming that the idle rotational speed at normal temperature is rotational speed NE_idle, torque TR is set to attain the operation point indicated by P1 from operation line W20. The relationship between rotational speed NE and torque TR to achieve required power PW1 corresponding to point P1 is indicated by line W10 in FIG. 8.

In the case where only engine rotational speed NE is simply modified to rotational speed NE_idle# according to the idle speed modification control set forth in the first and second embodiments, torque TR will change according to line W10 when the distribution of the required power towards engine 160 is the same. Engine 160 will be driven at the operation point of P2.

Since this operation point of P2 is not located on operation line W20 corresponding to an optimum efficiency, engine 160 will be degraded in efficiency.

Therefore, the distribution of the required power towards engine 160 is modified such that, when the idle rotational speed is modified in the hybrid vehicle as shown in FIG. 1, the operation point subsequent to modification is located on operation line W20. In the example of FIG. 8, the required power towards engine 160 is modified from PW1 to PW2 such that engine 160 is driven at a point P3 where the rotational speed attains NE_idle# on operation line W20.

Figure 9:
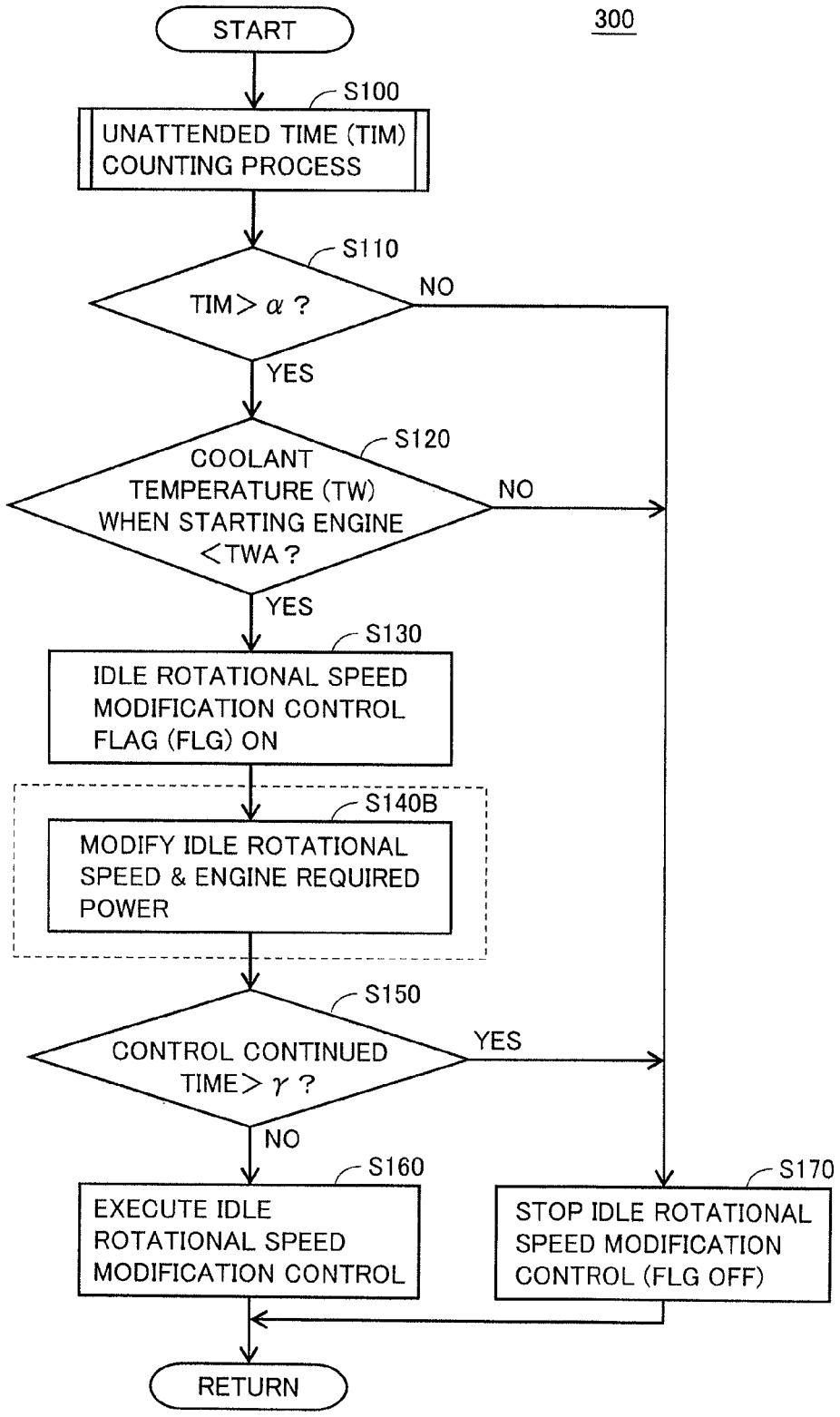
FIG. 9 is a flowchart to describe in detail an idle speed modification control process executed at the ECU in the third embodiment.

FIG. 9 is a flowchart to describe in detail the idle speed modification control process executed at ECU 300 according to the third embodiment. In FIG. 9, step S140 in the flowchart of FIG. 4 described in the first embodiment is replaced with S140B. In FIG. 9, steps coinciding with those in FIG. 4 will not be described repeatedly.

Referring to FIG. 9, when ECU 300 determines that unattended time TIM is greater than a predetermined reference value α (YES at S110), and that coolant temperature TW at the time of starting the engine is lower than threshold value TWA (YES at S120), control proceeds to S130 where idle rotational speed modification control flag FLG is set ON.

Then, control proceeds to S140B where ECU 300 sets the idle rotational speed using the map as shown in FIG. 2 or FIG. 6. In addition, ECU 300 determines the required power at which the efficiency of engine 160 is optimum at the set idle rotational speed subsequent to modification, and sets the distribution of the driving force of engine 160 and motor generators 130, 135.

Then, control proceeds to S150 where ECU 300 executes idle operation using the idle rotational speed and the required power towards engine 160 set at S140B until the continuing time of idle rotational speed modification control reaches a predetermined threshold value γ.

By the control according to the process set forth above, and modifying the required power such that the engine is driven at the optimum efficiency according to modification in the idle rotational speed in a hybrid vehicle, reduction in the overall efficiency of the vehicle can be suppressed while preventing resonance in a low-temperature environment.

Fourth Embodiment

The first to third embodiments were described based on a configuration in which, when the idle rotational speed is to be modified, the resonant rotational speed of the driving force transmission system corresponding to the unattended time in a low-temperature environment is set using a map as shown in FIGS. 2 and 6 determined in advance by experiments and the like.

However, it is possible that the relationship between the unattended time and resonant rotational speed may vary from a predetermined relationship due to the property of the mount changing by aging degradation or damage, or by the influence of the surrounding environment.

The fourth embodiment is directed to a configuration in which the idle rotational speed is adjusted depending upon whether or not resonance is actually occurring during idle operation taking advantage of a signal from a vibration sensor provided at the vehicle.

Figure 10:
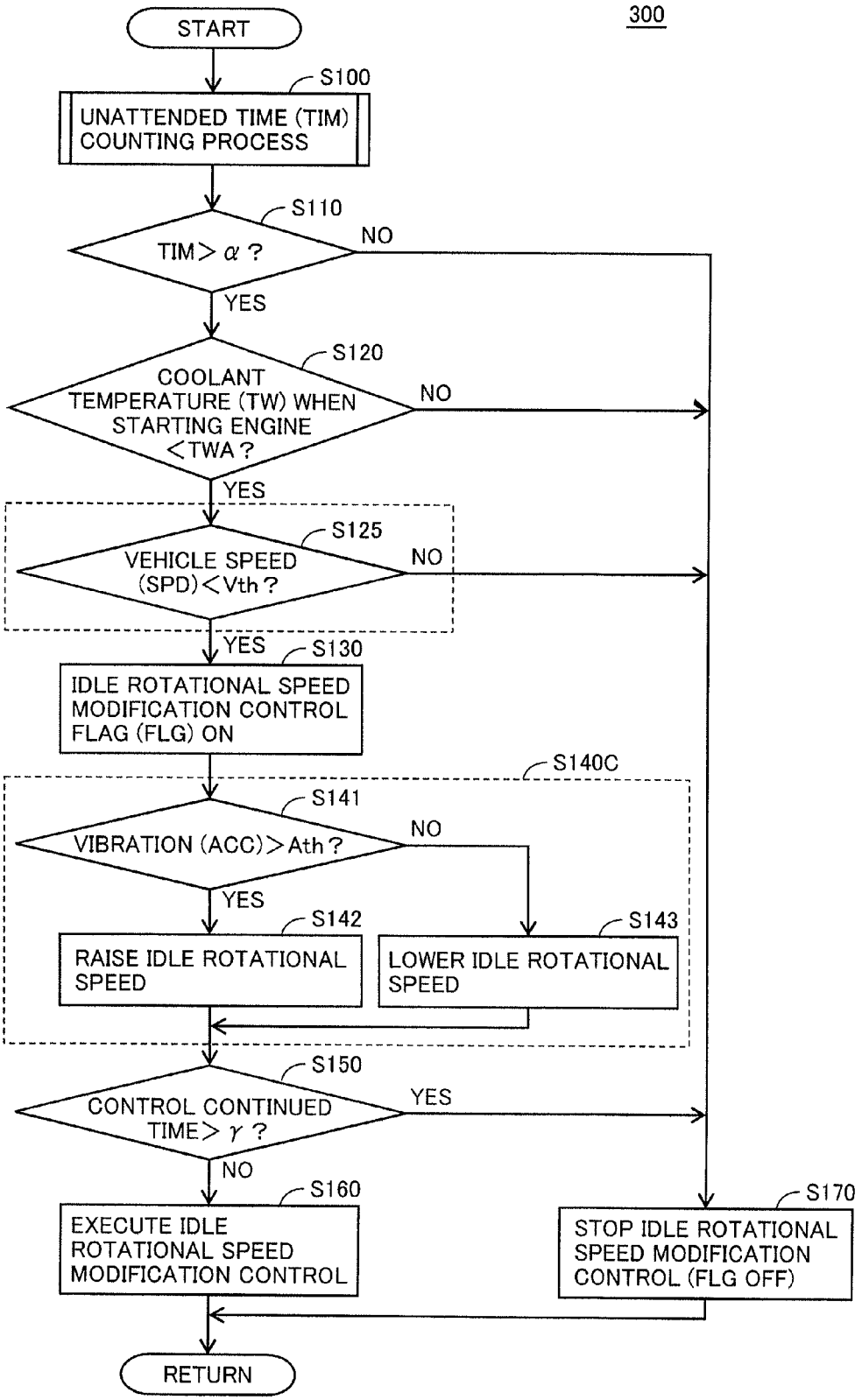
FIG. 10 is a flowchart to describe in detail an idle speed modification control process executed at the ECU in the fourth embodiment.

FIG. 10 is a flowchart to describe in detail an idle speed modification control process executed at ECU 300 according to the fourth embodiment. FIG. 10 has step S125 added to the flowchart of FIG. 4 described in the first embodiment, and S140 replaced with S140C. S140C includes S141-S143. In FIG. 10, steps coinciding with those in FIG. 4 will not be repeatedly described.

Referring to FIG. 10, when a determination is made that unattended time TIM is greater than a predetermined threshold value α (YES at S110), and coolant temperature TW at the time of starting the engine is lower than threshold value TWA (YES at S120), control proceeds to S125 where ECU 300 determines whether vehicle speed SPD from a speed sensor is smaller than a predetermined threshold speed Vth. This is directed to eliminating the influence of vibration occurring due to the road state and the like during running.

When vehicle speed SPD is greater than or equal to reference speed Vth (NO at S125), control proceeds to S170 where the process ends without carrying out idle speed modification control.

When vehicle speed SPD is less than reference speed Vth (YES at S125), control proceeds to S130 where ECU 300 sets idle rotational speed modification control flag FLG ON.

At S141, ECU 300 determines whether or not the degree of vibration acceleration ACC from vibration sensor 180 is greater than a threshold value Ath.

When the degree of vibration acceleration ACC is greater than threshold value Ath (YES at S141), ECU 300 determines that the possibility of resonance occurring during idle operation is high, and modifies the idle rotational speed to increase. Accordingly, ECU 300 functions to cause the idle rotational speed to fall away from the resonant rotational speed of the driving force transmission system. At this stage, the amount of modifying the idle rotational speed may be altered at one time to rotational speed NE_idle# shown in FIG. 2, or the amount of modification may be varied according to the degree of vibration. Furthermore, modification may be carried out gradually in steps of smaller predetermined amount while monitoring the vibration degree.

When the degree of vibration acceleration ACC is less than or equal to threshold value Ath (NO at S141), control proceeds to S143 where ECU 300 reduces the idle rotational speed in a range where vibration is not increased with idle rotational speed NE_idle corresponding to normal temperature as the lower limit.

At S150, ECU 300 executes idle operation using the idle rotational speed set at S140C until the continuation time of idle rotational speed modification control reaches predetermined reference value γ.

By the control according to the process set forth above, and adjusting the idle revolution speed while feeding back the actual vibration at the vehicle, idle operation can be carried out at an idle rotational speed at which occurrence of resonance is reliably avoided.

Although the fourth embodiment was described based on the case where the idle rotational speed is set according to the vibration acceleration from a vibration sensor, the idle rotational speed may be temporarily modified using the map and the like described in the first to third embodiments, and then correct the idle rotational speed based on the vibration acceleration as set forth in the fourth embodiment.

Although the above description is based on a case where the resonant rotational speed of the driving force transmission system varies according to the hardening of the mount, the present invention is applicable to the case where the resonant rotational speed of the driving force transmission system varies under an environment where the vehicle is in a low-temperature environment, not limited to a factor by the mount.

It should be understood that the embodiments disclosed herein are illustrative and non-restrictive in every respect. The scope of the present invention is defined by the terms of the claims, rather than the description of the embodiments set forth above, and is intended to include any modifications within the scope and meaning equivalent to the terms of the claims.

REFERENCE SIGNS LIST

100 vehicle; 110 power storage device; 115 SMR; 120 PCU; 121 converter; 122, 123 inverter; 130, 135 motor generator; 140 power transmission gear; 150 driving wheel; 160 engine; 165, 170 temperature sensor; 180 vibration sensor; 300 ECU; 310 count unit; 320 idle speed setting unit; 330 engine control unit; C1, C2 capacitor; NL1 ground line; PL1, PL2 power line

The invention claimed is:

1. A control device for an internal combustion engine, said internal combustion engine being attached to a vehicle using a fixture member, a resonant frequency of a driving force transmission system including said internal combustion engine having a property of increasing as said fixture member is reduced in temperature, said control device counting a stopped time of said internal combustion engine under a state where a value associated with temperature is below a threshold value, as said stopped period, and when said stopped period is long, setting an idle rotational speed of said internal combustion engine at a value differing from the value set when said stopped period is short.

2. The control device for an internal combustion engine according to claim 1, wherein said control device sets said idle rotational speed at a greater value when said stopped period is long as compared to the value set when said stopped period is short.

3. The control device for an internal combustion engine according to claim 2, wherein said control device sets the idle rotational speed when said stopped period exceeds a predetermined reference value at a value differing from the idle rotational speed set when said stopped period is below said reference value.

4. The control device for an internal combustion engine according to claim 3, wherein said control device sets said idle rotational speed at a first idle rotational speed when said stopped period is below the predetermined reference value, and at a second idle rotational speed differing from said first idle rotational speed when said stopped period exceeds said reference value, said second idle rotational speed is set at a value larger than the value of said first idle rotational speed.

5. The control device for an internal combustion engine according to claim 4, wherein said control device sets said idle rotational speed at said second idle rotational speed when a value associated with a temperature during starting said internal combustion engine is below a threshold value, and said stopped period exceeds said reference value.

6. The control device for an internal combustion engine according to claim 4, wherein said control device modifies said second idle rotational speed according to said stopped period when said stopped period exceeds said reference value.

7. The control device for an internal combustion engine according to claim 6, wherein said control device increases said second idle rotational speed when said stopped period is long than when said stopped period is short in an event of said stopped period exceeding said reference value.

8. The control device for an internal combustion engine according to claim 4, wherein said internal combustion engine has a detection unit provided for detecting vibration at said internal combustion engine, and said control device modifies said second idle rotational speed according to a value associated with a degree of vibration at said internal combustion engine based on a signal from said detection unit.

9. The control device for an internal combustion engine according to claim 8, wherein said control device sets said second idle rotational speed at a greater value when a value associated with a degree of said vibration is large, as compared to the value set when the value associated with the degree of said vibration is small.

10. The control device for an internal combustion engine according to claim 4, wherein said control device returns said idle rotational speed to said first idle rotational speed when a state where said idle rotational speed is set at said second idle rotational speed exceeds a predetermined time.

11. The control device for an internal combustion engine according to claim 4, wherein said internal combustion engine is used together with a traction motor, said control device controls said internal combustion engine and said traction motor such that required driving force is generated from said internal combustion engine and said traction motor, and when said idle rotational speed is set at the second idle rotational speed, sets an output of said internal combustion engine at a value differing from the value set when said idle rotational speed is set at said first idle rotational speed.

12. The control device for an internal combustion engine according to claim 11, wherein said control device controls said internal combustion engine according to a map having defined in advance an operation line defining a relationship between rotational speed and driving force of said internal combustion engine, and when said idle rotational speed is set at said second idle rotational speed, said control device alters a driving force of said internal combustion engine according to said operation line.

13. The control device for an internal combustion engine according to claim 1, wherein said control device resets a count of said stopped period when said internal combustion engine is started.

14. A vehicle comprising:

an internal combustion engine, and a control device for controlling said internal combustion engine, said internal combustion engine being attached to a vehicle using a fixture member, a resonant frequency of a driving force transmission system including said internal combustion engine having a property of increasing as said fixture member is reduced in temperature, said control device counting a stopped time of said internal combustion engine under a state where a value associated with temperature is below a threshold value, as said stopped period, and when said stopped period is long, setting an idle rotational speed of said internal combustion engine at a value differing from the value set when said stopped period is short.

15. The vehicle according to claim 14, further comprising an electric motor, said vehicle running using at least one of a driving force generated by said internal combustion engine and a driving force generated by said electric motor, said control device controlling distribution between the driving force generated by said internal combustion engine and the driving force generated by said electric motor, such that required driving force is output, said control device altering the driving force generated by said internal combustion engine in response to modification in said idle rotational speed.

* * * * *